United States Patent [19]

Ulbricht

[11] 4,245,435

[45] Jan. 20, 1981

[54] HIGH THERMAL EFFICIENCY WINDOW

[75] Inventor: Roger Ulbricht, Hicksville, N.Y.

[73] Assignee: Flour City Architectural Metals, a division of the Segrave Corporation, New York, N.Y.

[21] Appl. No.: 81,638

[22] Filed: Oct. 4, 1979

[51] Int. Cl.[3] ..... E06B 7/08

[52] U.S. Cl. ..... 49/64; 52/473; 160/107

[58] Field of Search ..... 52/473; 49/46; 160/107

[56] References Cited

U.S. PATENT DOCUMENTS

| | | | |
|---|---|---|---|
| 922,705 | 5/1909 | Lempert | 49/64 |
| 2,239,528 | 4/1941 | Knudsen | 49/64 |
| 2,838,109 | 6/1958 | Persson | 49/65 X |
| 3,022,549 | 2/1962 | Cummings | 49/64 |
| 3,318,360 | 5/1967 | Persson | 160/107 |
| 4,076,068 | 2/1978 | Archer et al. | 160/107 |
| 4,091,592 | 5/1978 | Berlad et al. | 52/788 |

*Primary Examiner*—Alfred C. Perham

*Attorney, Agent, or Firm*—Mark T. Basseches; Paula T. Basseches

[57] ABSTRACT

A high thermal efficiency window which is comprised of a low conductivity frame carrying a spaced pair of panes or lites. The space between the panes is divided into a series of vertically spaced-apart cells by a blind structure disposed between the panes, the slats of the blinds being essentially in contact with the interior faces of the panes whereby convection losses are minimized. The device is characterized by the blind being shiftable between an open or see-through configuration and a privacy configuration, the longitudinal edges of the elements defining the blinds being in contact with the interior faces of the panes in both said see-through and privacy configurations thereof.

12 Claims, 4 Drawing Figures

FIG. 1
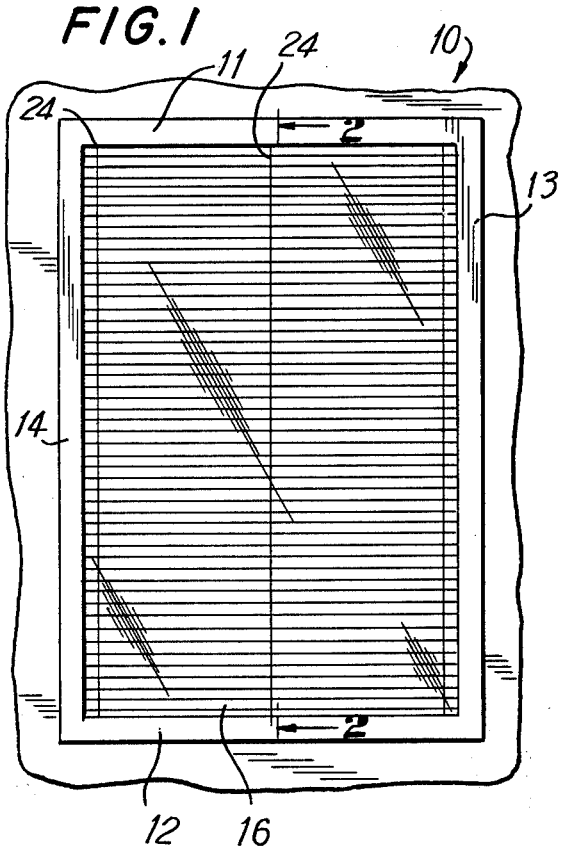
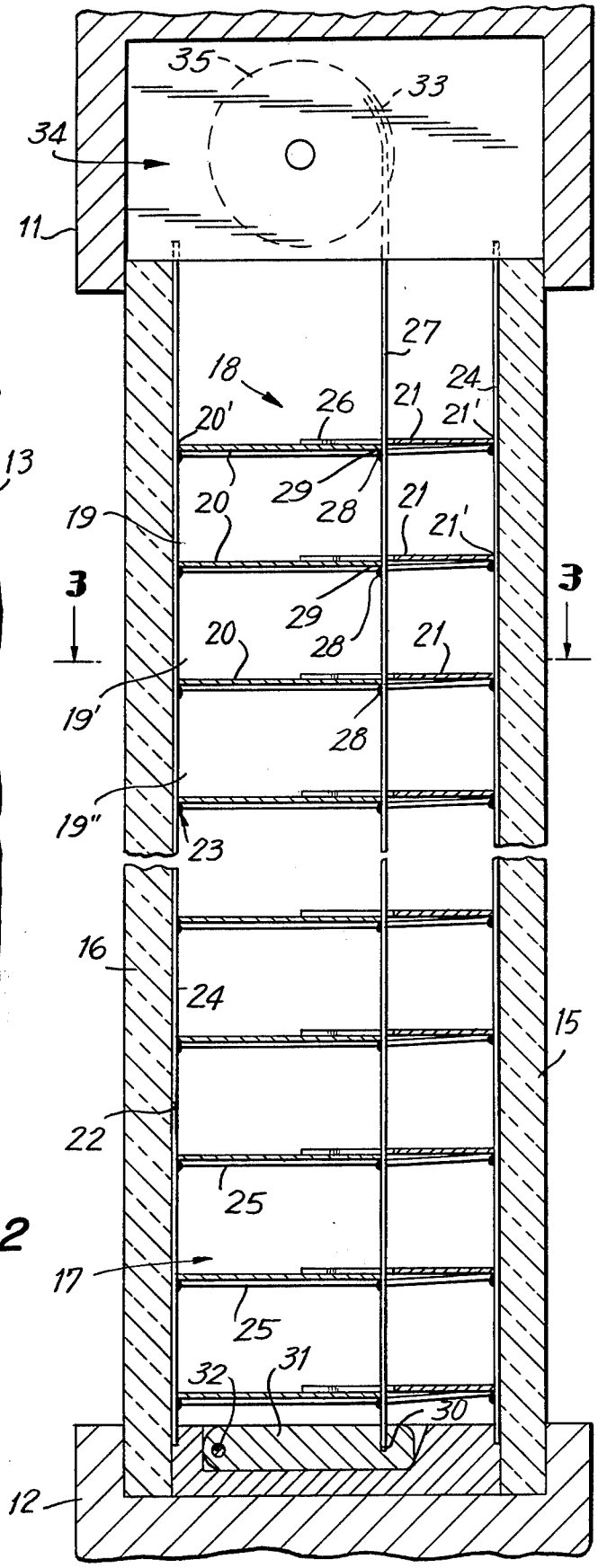
FIG. 2

HIGH THERMAL EFFICIENCY WINDOW

BACKGROUND OF THE INVENTION

1. Field of the Invention

The present invention is in the field of windows and is directed more particularly to a thermal window construction having minimum heat transfer looses.

The invention is more particularly directed to an improved window of the type having two or more panes, a blind structure being interposed between the panes, the blind being shiftable between privacy and see-through configurations.

2. The Prior Art

With the increasing costs of energy, greater emphasis is placed upon the provision of window structures having minimal heat loss. Numerous expedients have been relied upon to reduce heat loss through window devices. Such expedients have included the provision of double pane windows, the frame portion of which has been formed either of a low conductivity material such as wood or plastic or, where high conductivity materials are used, the provision of a thermal break between inner and outer high conductivity components.

It is also known, in order to reduce convection losses resulting from currents generated within the space between the panes, to employ blind structures, such as Venetian blinds.

Desirably, such blind structures are adjustable to pass maximum radiation during the winter and minimum radiation during the summer.

U.S. Pat. Nos. 2,239,528 of Apr. 22, 1941 to Knudsen, 3,022,549 of Feb. 27, 1962 to Cummings, 4,076,068 of Feb. 28, 1978 to Archer, 4,091,592 of May 30, 1978 to Berlad, for example, pertain to blind structures interposed between the glass panes of a window structure. Such blind structures, when they are adjusted to their so-called see-through condition wherein the blades or slats defining the blind are essentially horizontally arrayed, tend to divide the space between the windows into a series of vertically stacked air spaces which reduce heat loss through convection to a greater degree than if the entire space between the panes were not subdivided.

From the standpoint of thermal efficiency, the blind structures heretofore known lose much of their convection impeding function when the same are shifted from a see-through to a privacy mode. The reason for such loss is that in the see-through mode the slats defining the blinds extend substantially across the entire space between the panes and function as an effective means for dividing the space into vertically stacked seals. However, as soon as the slats of the blinds are tilted to provide a privacy mode, the edge portions thereof are shifted away from the inner surface of the panes, with resultant formation of spaces adjacent the panes, with consequent increase in convective activity and resultant heat loss.

SUMMARY OF THE INVENTION

The present invention may be summarized as directed to an improved thermal insulating window of the type which comprises a convection resistant frame carrying two or more parallel panes or lites of glass. The space between the panes is occupied by a blind structure which is shiftable between a see-through and a privacy mode. In accordance with the invention, the blind structure, in both the see-through and privacy modes maintains a closed cell condition wherein convection losses experienced in window structures heretofore known are eliminated in all modes or positions of the blind.

The invention is further directed to a device of the type described wherein adjustment of the blind between its see-through and privacy modes is readily effected and the apparatus for achieving such adjustment is simple and inexpensive.

Still more particularly, the present invention is directed to a thermal window device wherein two or more panes or lites of glass are supported in spaced parallel relation and between which panes there is mounted a blind structure including a first series of slats having longitudinal edges engaging a inner face of one pane, the slats extending part way toward the other pane. A second series of slats is supported with its longitudinal edges engaging against or disposed immediately adjacent the other pane, the slats of the second series extending part way toward the first mentioned pane. The edge portions of the slats overlap, with the free edges of the slats of one series resting upon and being supported by the slats of the other series.

The slats of both series are pivotally mounted about horizontal pivot axes coincident with or closely adjacent the respective panes.

Operating means are provided for lifting the free edges of the overlapped series of slats whereby a concomitant and opposite tilting movement is applied to the overlapping series of slats, whereby the slats of the first and second series are angularly oriented relatively to each other to provide a privacy mode.

By appropriate operation of the operator controlling the overlapped series of slats, the slats of the first and second series may be arrayed in parallelism to provide a see-through function or by an angular orientation to provide a privacy function, the pane-adjacent edges of the slats in all instances remaining immediately adjacent the inner surfaces of the panes whereby a series of closed, vertically offset cells are formed at all adjusted positions of the blind, the cells including the panes as boundaries in all instances.

The structure of the invention maintains the sealed cell configuration not only in the see-through mode but also in the privacy mode, resulting in an improved thermal isolation of interior from exterior environments.

Accordingly it is an object of the present invention to provide an improved thermal window construction.

A further object of the invention is the provision of a thermal window construction of the type described wherein there is included between a spaced parallel pair of panes a blind structure shiftable between see-through and privacy configurations, the blind structure dividing said space into a series of vertically offset closed cells under all conditions of operation.

A further object of the invention is the provision of a device of the type described wherein articulation of the blind structure may be accomplished without the formation of spaces between the longitudinal side edges of the blind structure and the glass panes.

A still further object of the invention is the provision of a device of the type described wherein adjustment of the blind may be accomplished by a simple operator mechanism.

To attain these objects and such further objects as may appear herein or be hereinafter pointed out, reference is made to the accompanying drawings, forming a part hereof, in which:

FIG. 1 is a front elevational view of a window construction in accordance with the invention;

FIG. 2 is a magnified section view taken on the line 2—2 of FIG. 1 and disclosing the blind in the see-through configuration;

Figure 3:
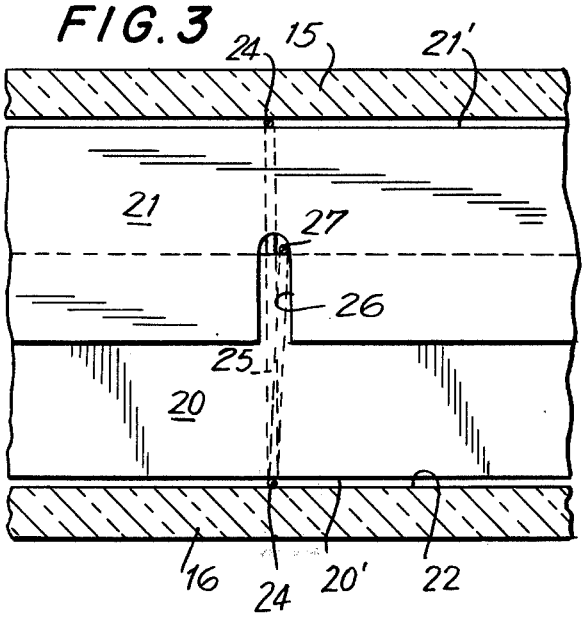
FIG. 3 is a horizontal section taken on the line 3—3 of FIG. 2.

Referring now to the drawings, there is shown in FIG. 1 a window construction including a frame 10 having a head member 11, a sill member 12 and side members 13, 14. The frame 10, which has been illustrated with a minimum of detail, is comprised either of a material such as wood having a high degree of resistance to thermal flow, or may be comprised of aluminum or like metal. In the latter case, as is conventional, the frame structure may be formed of an inner rectangular frame and an outer rectangular frame separated by a thermal break of rubber, vinyl or like insulating material to prevent the formation of a high conductivity heat bridge between the inside and the outside environments. Since thermal break windows are well known per se, there is no advantage to be derived from illustrating details of the construction thereof. However, reference may be made to Persson U.S. Pat. No. 2,838,109 of June 19, 1958 and 3,318,360 of May 9, 1967.

The frame structure 10 supports an inner glass lite or pane 15 and an outer glass lite or pane 16, which panes define a space or chamber 17 therebetween.

A blind structure 18 is disposed within the space 17, which blind structure in all modes of operation divides the space 17 into a series of vertically displaced cells 19, 19', 19''. As is known, division of the space 17 into a series of discrete cells running essentially the entire width of the window minimizes convective currents which form a significant means of heat transfer between the inner and outer panes.

The blind structure 18 of the present invention is comprised of a first series of slats 20 and a second series of slats 21. The slats 20 of the first series have their free edge portions 20' supported immediately adjacent or in abutting engagement with the inner face 22 of pane 16 by pivotal connection of the slats 20 with the vertically extending ladder assembly 23.

The ladder assembly may comprise merely a series of vertically extending fabric tapes 24, 24 adjacent the inner and outer panes, the vertical tapes being connected by transversely extending webs or rungs 25.

Optionally, the free edges 20' of the slats 20 may be pivotally connected to the vertical tapes 24 by physical connection at or adjacent the edges. Alternatively, the slats 20 may merely be laid atop the transverse webs 25, the migration away from the tapes 24 being effected in the manner hereinafter set forth.

For optimum isolation and absolute minimized convection losses, the edges 20' of the slats 20 may be slightly recessed in the areas in registry with the tapes 24 such that the edges 20' may extend slightly beyond the tapes and into engagement with the inner face of the window pane 16. As a practical matter, however, it is sufficient if the edges 20' are separated from the inner face of the pane by only the thickness of the tapes, which are typically 1/32" or less in thickness.

Slats 21 are similarly supported on the transversely extending webs or rungs 25, with the longitudinal edge portions 21' disposed immediately adjacent the inner face of the pane 15. As noted in respect of slats 20, an actual physical connection may be effected between the edges 21' and the tape 24. However, normally it is adequate to rely upon the parts, as hereinafter described, to maintain the desired juxtaposition of the edges 21' and interior face of the pane 15.

As may be recognized from an inspection of FIG. 2, for example, the slats 21 of the second series overlap the slats 20 of the first series.

The slats 21 are provided with transversely directed slots 26 which are disposed perpendicular to the longitudinal axes of the slats—see FIG. 3.

The slats 20 and 21, while illustrated as being essentially flat, may be of a slight arcuate configuration in order to afford additional structural integrity.

Figure 4:
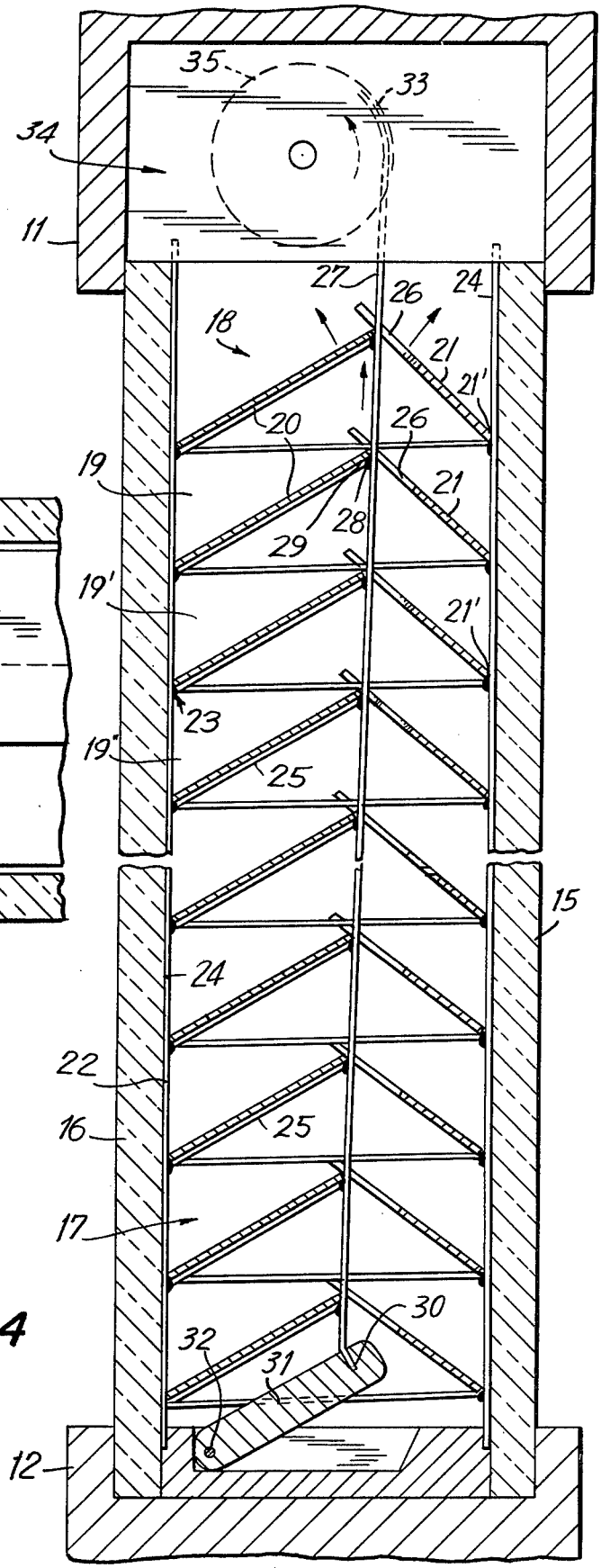
FIG. 4 is a view similar to FIG. 2 showing the blind in the privacy configuration.

The slats 20 and 21 are articulated between the see-through position of FIG. 2 and the privacy position of FIG. 4 by an operator member comprising one or more vertically directed operator cords 27 extending downwardly through the vertically aligned slots 26 of the slats 21. The operator member or members 27 are pivotally fixed, as at points 28, to the free edge portion 29 of the slats 20.

The lowermost ends 30 of the cords 27 are affixed to weight levers 31 recessed in the sill and pivotally secured therein as by pivot pins 32, the function of the weight members 30 being to provide a downward restoring force to the cords 27 when the same are lifted.

The upper ends 33 of the cords 27 are secured to a control mechanism 34 for lifting and lowering the cords 27. Illustratively the control mechanism may be comprised of a cylindrical drum 35 recessed in the head 11 of the frame, the rotated position of the drum 35 being governed by a manually available control cord or like mechanism (not shown).

The operation of the device will be apparent from the preceding description.

When the drum 35 is rotated in an anti-clockwise direction from the position shown in FIG. 2, the cord or cords 27 will be lifted, causing the slats 20 to pivot about pivot points 20' in an anti-clockwise direction. The lifting of the slats 20 is accompanied by a clockwise pivotal movement of the slats 21, which are stacked or layered atop the slats 20, causing the parts to move to the position of FIG. 4 and causing the weighted lever 31 to shift an anti-clockwise direction.

Clearance for the pivotal movement of the slats 21 is provided by the slots 26 in the slats 21.

The weight member 31 provides a constant downward force maintaining the cords 27 in a tautened condition.

It will be observed from an inspection of FIG. 4 tht when the slats are shifted to their privacy position, the weight of the slats of both series will tend to urge the pane-adjacent edges thereof 20' and 21' in an outward direction or toward the panes.

It will further be observed that the movement from the see-through to the privacy condition is unaccompanied by any movement of the side edge portions away from the inner faces of the panes.

Preferably, stop means are provided for the drum 35, limiting the amount of upward movement of the cords 27 to prevent over-lifting or dislocation of the blind components.

When it is desired to return the blind to its see-through condition, it is merely necessary to rotate the drum 35 in a clockwise direction, whereby the weight 31 draws the cords 27 in a downward direction, carrying with it the slats 20 and, concomitantly, the slats 21 which rest atop the slats 20.

Although not illustrated, it will be apparent to those skilled in the art that the blind structure may be arranged to be lifted entirely as by a conventional lift mechanism for storage adjacent the upper edge of the window.

If the device is to be adapted to a lift configuration, it will be evident that, in view of the weighted lever affixed to the sill, the weighted base slat as conventionally employed in Venetian blind constructions should be employed.

From the foregoing description it will be evident that there is provided in accordance with the present invention a thermal window construction incorporating a simple blind structure shiftable between privacy and see-through configurations and providing in both said configurations a plurality of vertically stacked cells employing slats whose pane-adjacent edges remain against or in immediate juxtaposition to the opposed inner surfaces of the panes in the privacy and see-through configurations of the slats and, indeed, at all intermediate positions.

The construction is highly advantageous in that the weight of the slats tends to urge the free edges of the slats nearest the panes laterally outward toward the panes, whereby the possibility of the formation of any significant gaps between the slates and the panes is eliminated. By minimizing clearances between the edges of the slats and the panes, the formation of convective currents, with attendant heat loss, is avoided.

As will be evident to those skilled in the art and familiarized with the instant disclosure, numerous variations may be made in details of construction of the invention hereof without departing from the spirit of the invention. Accordingly, the invention is to be broadly construed within the scope of the appended claims.

Having thus described the invention and illustrated its use, what is claimed as new and is desired to be secured by Letters Patent is:

1. In combination, a window structure comprising a low conductivity window frame including a head member, a sill member and side members, first and second pane members fixed to said frame in spaced parallel relation and a convection resistant blind structure disposed between said panes, said blind structure including a first ladder assembly adjacent the inner surface of said first pane, a second ladder assembly adjacent the inner face of said second pane, a first series of vertically spaced parallel slats disposed between said panes and supported on said first ladder assembly, said slats extending substantially the full width between said side members, the slats of said first series including an outer longitudinal edge portion disposed in abutting relation to said first pane member and an inner longitudinal edge portion terminating in spaced relation to said second pane member, said slats being supported on said first ladder assembly for pivotal movement about horizontal pivot axes substantially coincident with said inner face of said first pane, a second series of vertically spaced parallel slats disposed between said panes and supported on said second ladder assembly, the slats of said second series including outer longitudinal edge portions disposed in abutting relation to said second pane member and inner longitudinal edge portions terminating in spaced relation to said first pane, the slats of said second series being supported on said second ladder assembly for pivotal movement about a horizontal pivot axis substantially conincident with said inner face of said second pane, the slats of said first series each underlapping and supporting a slat of said second series, the slats of said second series each including a slot extending normal to the axis thereof, the slots of said slats being in vertical alignment, and a vertically arrayed operator member extending through said slots, said operator member being secured to the slats of said first series, whereby the angular orientation of the slats of both said series is varied responsive to vertical movements of said operator member without departure of said pivot axes from said inner faces of said panes.

2. The apparatus of claim 1 wherein said operator member comprises a cord, means in said head member for raising and lowering said cord, and means in said sill member connected with said cord for urging said cord in a downward direction.

3. The apparatus of claim 1 wherein said operator member is secured to said slats of said first series adjacent said outer edges thereof.

4. Apparatus in accordance with claim 3 wherein each slat of said first series is in substantial coplanar alignment with a slat in said second series to define a see-through position, said slats being angularly offset to define a privacy condition responsive to actuation of said operator member.

5. Apparatus in accordance with claim 1 wherein the pivot axes of the slats of said first and second series are in heightwise alignment.

6. A thermal window structure comprising a low conductivity window frame including a head portion, a sill portion and side members, first and second pane members fixed to said frame in spaced parallel position, and a blind assembly disposed between said panes and shiftable between privacy and see-through configurations, said blind assembly, in combination with said panes, dividing the space between said frames into a series of vertically spaced, substantially completely closed cells in both said privacy and said see-through configurations,said blind assembly including a first series of slats extending from the inner face of said first pane part way toward said second pane, a second series of slats extending from the inner face of said second pane part way toward said first pane, means adjacent the inner faces of said panes for supporting the said slats of both said series for movement about horizontal pivot axes, each slat of one said series slidably engaging a slat of the other said series in said privacy and said see-through configurations, and operator means for shifting said slats between said privacy and said see-through configurations, the pane-adjacent edges of said slats being retained in juxtaposition to said inner faces of said panes in the course of said shifting movement.

7. A window structure in accordance with claim 6 wherein said means for supporting said slats comprise ladder assemblies.

8. A window structure in accordance with claim 6 wherein the slats of one said series are disposed in partial overlapping relation of the slats of the other said series, and said operator means comprises a vertically directed, vertically shiftable member operatively connected to the slats of said overlapped series.

9. A window structure in accordance with claim 8 wherein the slats of said overlapping series include a slot extending normal to the longitudinal axes thereof and said operating means extends through said slots.

10. A window structure in accordance with claim 9 wherein said operator means comprises a cord.

11. The apparatus in accordance with claim 10 and including means at said sill member connected with said cord for urging said cord in a downward direction.

12. The apparatus of claim 11 and including control means in said head member operatively connected to said cord for shifting said cord in said vertical direction.

* * * * *